US005324229A

United States Patent [19]

Weisbecker

[11] Patent Number: 5,324,229

[45] Date of Patent: Jun. 28, 1994

[54] TWO SECTION ECONOMIZER DAMPER ASSEMBLY PROVIDING IMPROVED AIR MIXING

[75] Inventor: Richard T. Weisbecker, La Crosse, Wis.

[73] Assignee: American Standard Inc., New York, N.Y.

[21] Appl. No.: 9,499

[22] Filed: Jan. 26, 1993

[51] Int. Cl.[5] ..... F24F 7/00

[52] U.S. Cl. ..... 454/233; 454/236; 236/49.3; 62/412

[58] Field of Search ..... 454/229, 233, 236, 239, 454/242, 186; 62/412; 236/49.3

[56] References Cited

U.S. PATENT DOCUMENTS

| | | | |
|---|---|---|---|
| 1,909,164 | 5/1933 | Bulkeley | 236/49.3 |
| 3,324,782 | 6/1967 | Norris et al. | 454/236 |
| 3,387,649 | 6/1968 | Mullins et al. | 165/59 |
| 4,054,035 | 10/1977 | Trelease | 62/83 |
| 4,058,253 | 11/1977 | Munk et al. | 454/229 |
| 4,129,116 | 12/1978 | Kent | 126/270 |
| 4,205,381 | 5/1980 | Games et al. | 364/505 |
| 4,267,967 | 5/1981 | Beck et al. | 236/49.3 |
| 4,605,160 | 8/1986 | Day | 236/13 |
| 4,850,264 | 7/1989 | Kiser | 98/1.5 |

OTHER PUBLICATIONS

The Trane Company, "Large Commercial Single-Zone Rooftop Air Conditioners with VAV Controls", Jul. 1990, FIGS. 22 and 27.

Honeywell, "Variable Air Volume Systems Manual", 1980 Edition, pp. 23-26.

*Primary Examiner*—Henry A. Bennet
*Assistant Examiner*—William C. Doerrler
*Attorney, Agent, or Firm*—William J. Beres; William O'Driscoll; Peter D. Ferguson

[57] ABSTRACT

A two section damper assembly and method of use is disclosed for avoiding stratification of cooled air in an air conditioning system. The damper assembly is especially adapted for use in variable air volume air conditioning systems that include an economizer. During the economizer mode of operation, the building in which the air conditioning system is installed is cooled at least partially with outside air as opposed to cooling solely by mechanical means and the volume of air that is required may be relatively low. The variable two section damper assembly ensures that an adequate volume of cooling air is taken in and that there is adequate velocity of the outside air and return air to ensure mixing of the outside air with the return air in order to avoid the stratification of the supply air that can occur. The damper assembly is variable in the size of the opened area and in the direction that the individual vanes of the damper assembly are set.

12 Claims, 4 Drawing Sheets

TWO SECTION ECONOMIZER DAMPER ASSEMBLY PROVIDING IMPROVED AIR MIXING

TECHNICAL FIELD

The present invention relates generally to air conditioning systems for buildings. More particularly it pertains to a variable two section damper assembly useful with variable air volume air conditioning systems that operate a portion of the time in an economizer mode.

BACKGROUND OF THE INVENTION

So called "rooftop" air conditioning systems have steadily evolved since their introduction in the 1960's for heating and cooling of commercial buildings. Rooftop units are characterized as forced air units that distribute the conditioned air by means of fans, through supply ducts, to each of the ventilated zones of a building. The systems are closed loop systems in the sense that conditioned air is provided to the spaces of a building to cool or heat the spaces, and then is returned by return ducts to the heating or refrigeration system to be heated or cooled again.

The most recent rooftop designs are variable air volume (VAV) systems. VAV systems are designed to operate at a constant supply air temperature, for example, 55° F. The volume of the supply air provided to the ventilated zones of the building is varied in order to satisfy particular cooling or heating requirements. On a hot day, for example, when the zones are fully occupied by people, a high volume of cooled air at 55° F. would be needed to satisfy the cooling requirements. On a cool day, when few people are occupying the building, a substantially reduced volume of cooled air at 55° would be required to meet design cooling requirements. The fans in a VAV system are controlled to vary the volume of conditioned air that is being supplied to the various zones at any given time, thereby keeping the temperature of the zones at a design temperature of, for example, 72° F.

The first VAV air conditioning systems provided all cooling by mechanical means. Thus, the compressor and the evaporator coil were operated frequently in order to cool the air distributed throughout a building. This was true even when the outside ambient air was relatively cool. As ways were sought to improve the efficiency and reduce the cost of cooling air, economizers were designed and installed on air conditioning systems. An economizer is a device that introduces outside air into the system to provide cooling when possible. Since VAV systems always supply air at a constant temperature of nominally 55° F., outside air is effective to assist in cooling at all times that the outside air temperature is less than 55° F.

Outside air is mixed by an economizer in a VAV system with the return air from the building cooling zones. The outside air is provided by the fans as cooled supply air to the ventilated zones in a continuous loop to keep the building at a comfortable temperature of, for example, 72° F. It will be appreciated that, as the temperature of the outside air is reduced, a much reduced volume of outside air is needed to cool the zones to a desired temperature. When the outside air is, for example, 10° F., very little outside air needs to be added to the return air to reduce the return air to 55° F. and to keep the zones at 72° F. In such conditions, the total air flow through the air conditioning system can typically be less than one third of the air conditioning system's full capacity, which occurs during 100% mechanical cooling.

The reduced volume of air flow at the lower outside air temperatures results in a problem called stratification in the supply ducts. This simply means that the return air and the outside air are not mixed together prior to delivery to the cooling zones. When the air in the main supply duct descending into the building becomes stratified, one side of the duct will have return air in it while the other side of the duct has outside air in it. Zones that are supplied off of the "return air" side of the duct receive air that is too warm and such zones are perceived by the occupants as being stale and stuffy. Zones that are supplied off of the "outside air" side of the duct, receive air that is very cool and these zones are perceived by the occupants as being cold and drafty.

The problem of stratification is made worse in the more recent VAV systems that are of a side-by-side' design. Side-by-side VAV systems are designed to have return air enter the rooftop-unit on one side of the unit and the outside air enter on the other side, as opposed to the "over and under" orientation of previous designs. The return air and the outside air each pass through a damper assembly and enter a common plenum, where mixing should occur. Side-by-side designs are preferable in that the air that is directed onto the coils of the evaporator is more uniform in temperature from the top to the bottom of the unit. However, at low air flow rates, the side-by-side design results in the fans drawing the return air and the outside air through the plenum of the rooftop unit in unmixed parallel, side-by-side flows. The air then enters the descending supply ducts in a stratified, unmixed manner. The problem of stratification is further exacerbated as rooftop designs are made wider to add additional cooling capacity. The plenum becomes wider, making it more difficult to effect adequate mixing under low flow conditions.

It is a primary object of the present invention to provide a damper assembly for the economizer of a VAV air conditioning system which accomplishes destratification effectively and efficiently, particularly when the air flow is relatively low.

It is a further object of the present invention to provide such a damper assembly that has a plurality of positionable and controllable sections to effect adequate air flow and mixing under all operating conditions of the air conditioning system operation.

These and further objects of the present invention will become apparent from the following description of the preferred and alternate embodiments.

The present invention provides an air damper assembly for use in an air conditioning apparatus providing conditioned air to a space. The air conditioning apparatus has an outside air portion through which outside air is admitted to the air conditioning apparatus and a return air portion through which return air is admitted to the air conditioning apparatus. The air conditioning apparatus is selectable between a mechanical cooling mode of operation during which the cooling is provided by mechanical means and an outside air cooling mode of operation during which the cooling is provided by admitting outside air to the air conditioning apparatus. The air damper assembly comprises an outside air damper and a return air damper. The outside air damper is for controlling the admission of outside air to the air conditioning apparatus, having a first outside air damper portion that is closed during the outside air cooling mode of operation and having a second outside air damper portion that is at least partially open during the outside air cooling and mechanical cooling modes of operation. The return air damper is for controlling the admission of return air to the air conditioning apparatus, having a first return air damper portion that is closed during the outside air cooling mode of operation and is selectable between the open and closed positions during the mechanical cooling mode of operation, and having a second return air damper portion that is at least partially open during the outside air cooling mode of operation and is selectable between the open and closed positions during the mechanical cooling mode of operation.

The present invention also provides an air damper assembly for use in an air conditioning system that provides conditioned air to a space. The air damper assembly has a return air admitting portion and an outside air admitting portion. The air damper assembly comprises a return air damper sub assembly for controlling the flow of return air and an outside air damper sub assembly for controlling the flow of outside air. The return air damper subassembly defines a return air aperture through which return air flows. The return air damper sub assembly has a first return air aperture control for controlling the opening and closing of a first portion of the return air aperture and a second return air aperture control for controlling the opening and closing of a second portion of the return air aperture. The outside air damper subassembly defines an outside air aperture through which outside air flows. The outside air damper sub-assembly has a first outside air aperture control means for controlling the opening and closing a first portion of the outside air aperture and a second outside air aperture control means for controlling the opening and closing of a second portion of the outside air aperture.

The present invention additionally provides a method of controlling an air conditioning system that supplies conditioned air to a space presenting an air conditioning demand. The air conditioning system has a return air admitting portion and an outside air admitting portion and an air damper assembly. The air damper assembly has a return air damper subassembly that controls the flow of return air. The return air damper subassembly has a first portion and a second portion. The air damper assembly also has an outside air damper subassembly that controls the flow of outside air. The outside air damper subassembly has a first portion and a second portion. The method of promoting a uniform temperature distribution throughout the air conditioning system comprises closing the first portion of the return air damper subassembly and closing the first portion of the outside air damper subassembly and at least partially opening the second portion of the return air damper subassembly and the second portion of the outside air damper subassembly at times of relatively low outside air flow. The method also comprises at least partially opening the second portion of the outside air damper subassembly and varying the first and second portions of the return air damper subassembly between the open and closed positions as a function of outside air temperature and cooling demand at times of relatively high outside air flow.

The present invention further provides a method of controlling an air conditioning system that supplies conditioned at a set conditioned air temperature air to a space presenting an air conditioning demand. The conditioned air is at least partially made up of outside air. The air conditioning system has a return air admitting portion and an outside air admitting portion and an air damper assembly. The air damper assembly having a return air damper subassembly that controls the flow of return air and an outside air damper subassembly that controls the flow of outside air. The return air damper subassembly has a first portion and a second portion. The outside air damper subassembly has a first portion and a second portion, the method of promoting a uniform temperature distribution throughout the conditioned air comprises the steps of: comparing the outside air temperature to the conditioned air temperature; closing the first portion of the return air damper subassembly and the first portion of the outside air damper subassembly at substantially all times when the conditioned air temperature exceeds the outside air temperature; varying the position of the second portion of the return air damper subassembly between the fully closed and the fully open positions as a function of the difference between the outside air temperature and the conditioned air temperature and the air conditioning demand at substantially all times when the conditioned air temperature exceeds the outside air temperature; and, varying the position of the second portion of the outside air damper subassembly between the fully closed position and a partially open position as a function of the difference between the outside air temperature and the conditioned air temperature and the air conditioning demand at substantially all times when the conditioned air temperature exceeds the outside air temperature.

The present invention yet further provides a method of controlling an air conditioning system that supplies conditioned at a set conditioned air temperature air to a space presenting an air conditioning demand, wherein the conditioned air is at least partially made up of outside air. The air conditioning system has a return air admitting portion and an outside air admitting portion and an air damper assembly. The air damper assembly has a return air damper subassembly that controls the flow of return air and an outside air damper subassembly that controls the flow of outside air. The return air damper subassembly has a first portion and a second portion. The outside air damper subassembly has a first portion and a second portion. The method of promoting a uniform temperature distribution throughout the conditioned air comprises the steps of: comparing the outside air temperature to the conditioned air temperature; varying the positions of the first and second portions of the return air damper subassembly between the fully closed position and at least a partially open position at substantially all times when the conditioned air temperature is less than the outside air temperature as a function of the difference between the outside air temperature and the conditioned air temperature and the air conditioning demand; and, varying the positions of the first and second portions of the outside air damper subassembly between the fully open position and at least a partially open position at substantially all times when the conditioned air temperature is less than the outside air temperature as a function of the difference between the outside air temperature and the conditioned air temperature and the air conditioning demand.

DETAILED DESCRIPTION OF THE DRAWINGS

Figure 1:
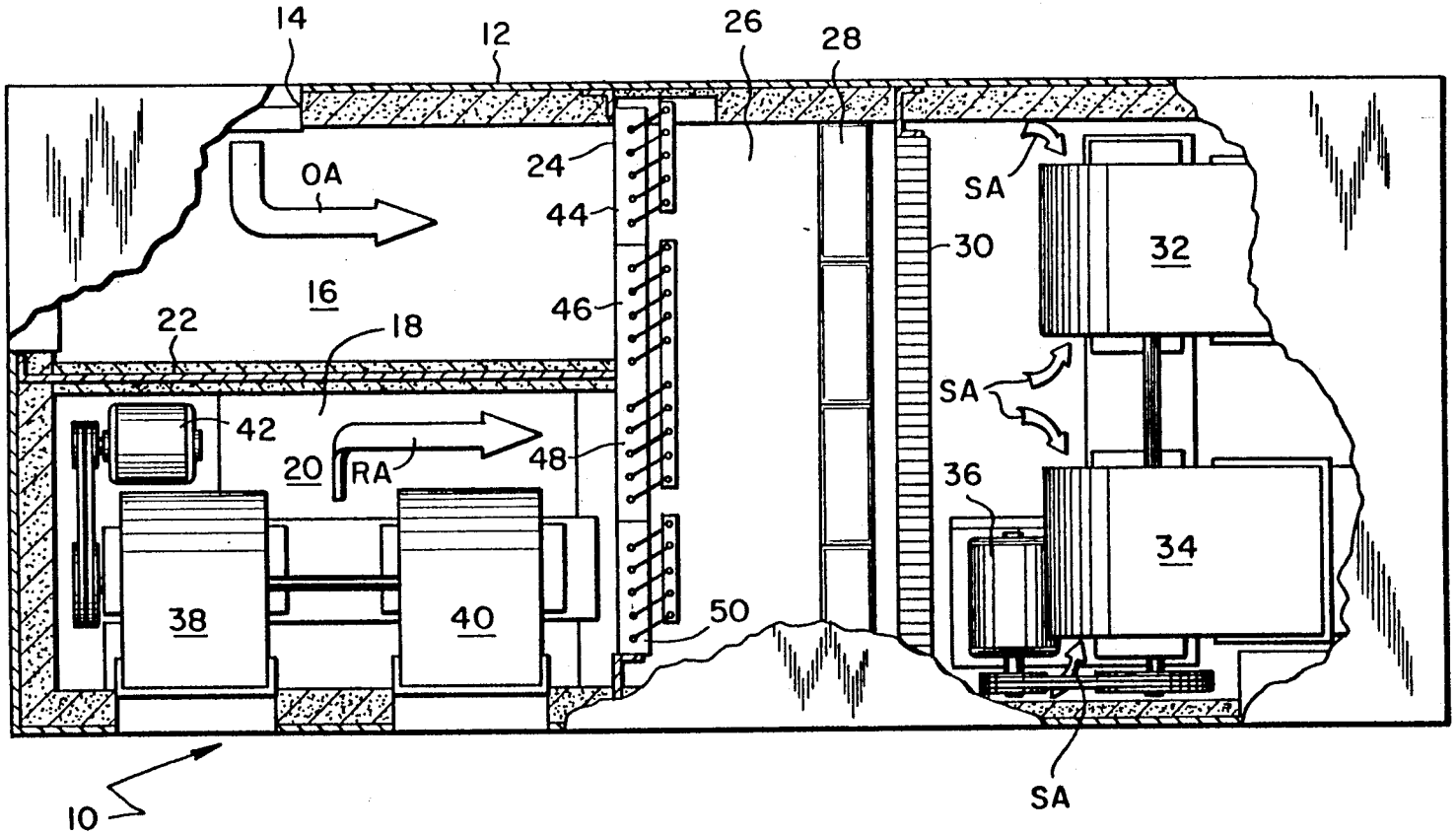
FIG. 1 is a top perspective view of a rooftop air conditioning system having a two section damper assembly in accordance with the present invention installed therein, and with a portion of the exterior housing broken away to reveal the inner mechanisms of the system.

Referring to FIG. 1, air conditioning unit 10 includes a sheet metal housing 12 of generally rectangular configuration adapted for mounting on the roof of a building. The housing 12 includes an outside air inlet opening 14 which leads into an outside air chamber 16. The flow of the outside air is indicated in FIG. 1 by an arrow OA.

A return air opening 18 in the bottom wall of housing 12 is in flow communication with the return air duct work from the building being served. The return air opening 18 opens into a return air chamber 20. The return air chamber 20 and the outside air chamber 16 are separated by fluid tight partition 22. Return air flows upward through the return air opening 18 into the return air chamber 20 as indicated by an arrow RA. The outside air chamber 16 is separated from the return air chamber 20 by the partition 22. FIG. 1 illustrates the side by side arrangement of outside air and return air that is favored in the design of VAV type air conditioning apparatus 10.

The flow of outside air and return air through the air conditioning apparatus 10 is controlled by a damper assembly 24. Flow is through a plenum 26 and into filters 28. After filtration the air flows past a heat exchange coil 30. The heat exchange coil 30 is to provide for conditioning the air flowing past it.

The outside and return air, after being conditioned by passing through the filters 28 and the heat exchange coil 30, is directed by fans 32, 34 downward into the supply air ducts (not shown) of the building being served. The conditioned air constitutes what is known as supply air and is indicated by arrows designated SA entering the sides of the fans 32, 34. The fans 32, 34 are driven in a common manner by an electric motor 36. The fans 32, 34 force the supply air downward through the supply ducts (not shown) into the cooling zones of the building being served.

Exhaust fans 38, 40 are operated when it is necessary to exhaust a large quantity of return air to the outside ambient air. The exhaust fans 38, 40 are driven in a common manner by an electric motor 42.

The general theory of operation of air conditioning apparatus of this type is well known to those skilled in the art. Accordingly, no further description is believed warranted, and the discussion now turns to a description of the novel damper assembly comprising the applicant's invention.

The damper assembly 24 is preferably comprised of four distinct damper groups, but in practice has been implemented using three distinct operational damper groups. The flow of outside air is controlled by an outer outside air damper 44 and an inner outside air damper 46. The flow of return air is controlled by an inner return air damper 48 and an outer return air damper 50. The operation of each of the air damper groups 44, 46, 48, and 50 that comprise damper assembly 24 is such that the inner outside air damper 46 and the inner return air damper 48 are controlled as a unit and the outer outside air damper 44 and the outer return air damper 50 are controlled as a unit. In practice, it has been found feasible to omit any modulation of the outer outside air damper 44 and simply leave that outer outside air damper 44 in a closed position for all modes of operation. The independent operation of all dampers 44, 46, 48 and 50 is also contemplated.

Each of the air dampers 44, 46, 48, and 50 are comprised of vanes 52 that are opened and closed in a coordinated fashion. Each vane 52 opens and closes about a pivot axis 54. The actuation of the positioning of the vanes is done in a conventional manner. In the closed position, vanes 52 form an overlapping joint 56 with the adjacent vane 52 to present an essentially airtight closure. Each of the air dampers 44, 46, 48, and 50 has an independent controller that controls the positioning of the vanes 52 that make up the respective air dampers 44, 46, 48, and 50 in a coordinated manner. In a preferred embodiment, the vanes 52 that makeup a particular air damper, e.g. air damper 44, 46, 48, or 50, are positioned such that the vanes 52 are, in all positions, parallel with one another. However, it is also contempated that the vanes 52 of a particular air damper, e.g. air damper 44, 46, 48 or 50, may be positioned such that, when partially or fully open, the vane angle progressively varies from one side of a particular damper to the other.

Figure 2:
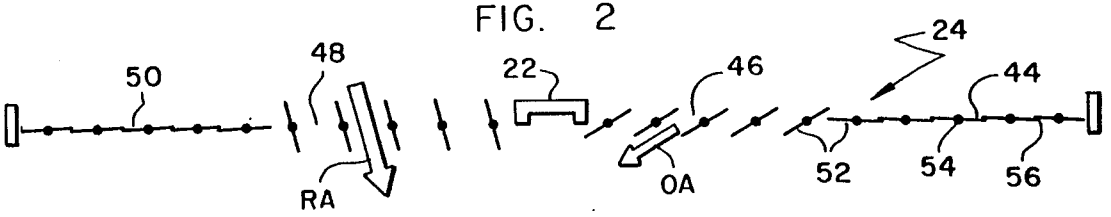
FIG. 2 is a schematic top perspective view of the sectional damper apparatus positioned for operation of the air conditioning system in the economizer mode, with low ambient outside air temperature and low cooling load on the air conditioning system.
Figure 3:
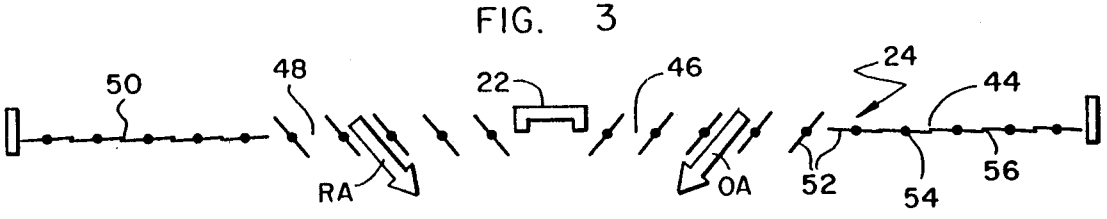
FIG. 3 is similar to FIG. 2, but with the damper apparatus positioned for operation of the air conditioning system in the economizer mode, with relatively higher ambient outside air temperature and relatively higher cooling load on the air conditioning system.
Figure 4:
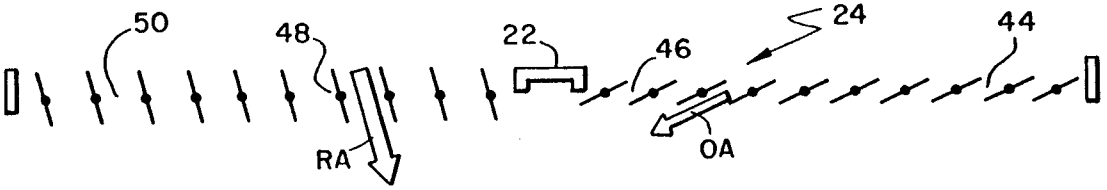
FIG. 4 is similar to FIG. 2, but with the damper apparatus positioned for operation of the air conditioning system in the mechanical cooling mode, with a minimum amount of outside air being admitted.
Figure 5:
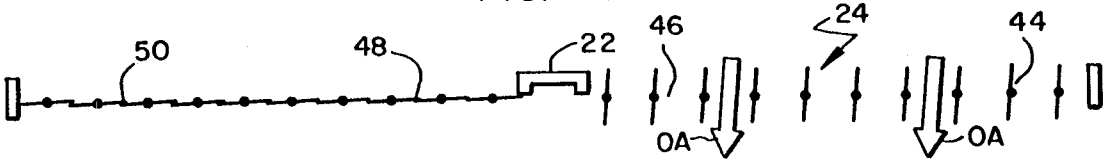
FIG. 5 is similar to FIG. 2, but with the damper apparatus positioned for operation of the air conditioning system in economizer mode with maximum outside air being admitted.

The operation of damper assembly 24 is best understood with reference to FIGS. 2, 3, 4, and 5. It should be noted that in all modes of operation of air conditioning apparatus 10, at least a minimum amount of outside air is admitted to the system, to ensure that the air within the building being served does not become stale and stuffy. Air conditioning apparatus 10 operates in two modes, the economizer mode and the mechanical cooling mode. In the economizer mode, cooling is provided by admitting relatively cool outside air. In the mechanical cooling mode, cooling is provided by mechanical means, such as by mechanically compressing a refrigerant and expanding it in the heat exchange coil 30, where the expanding refrigerant cools the air passing over the coils of the heat exchange coil 30. FIGS. 2 and 3 depict the economizer mode and FIGS. 4 and 5 depict the mechanical cooling mode. The controllers for each of the air dampers 44, 46, 48, 50 are capable of controlling the air dampers in an mode where one air damper may be open or partially open and another may be closed or in coordination with another particular air damper or all of the air dampers 44, 46, 48, 50.

The operating condition depicted in FIG. 2 can be described as low outside air temperature, and low cooling load from the building being served. A low cooling load means that relatively little heat is being generated in the building, as for example during non-working hours. In this condition only a small quantity of outside air is required to be mixed with the return air in order to bring the supply air down to the desired constant temperature, which, for example, may be 55° F. It is under this operating condition that stratification occurs. In order to counter stratification effects, the outer outside air damper 44 is closed and the outer return air damper 50 is closed. In the preferred embodiment, the outer outside air damper 44 and the outer return air damper 50 are closed for all operations of air conditioning apparatus 10 in the economizer mode.

The condition in which both the outer outside air the outer return air damper 50 are closed forces both the outside air and the return air to pass through the inner outside air damper 46 and the inner return air damper 48, respectively. An effect of closing the outer outside air damper 44 is that the limited volume of outside air that is entering the system must pass through a substantially smaller opening, the inner outside air damper 46. This smaller opening increases the velocity of the admitted outside air. The increased velocity is effective in promoting mixing of the outside air and the return air.

Figure 6:
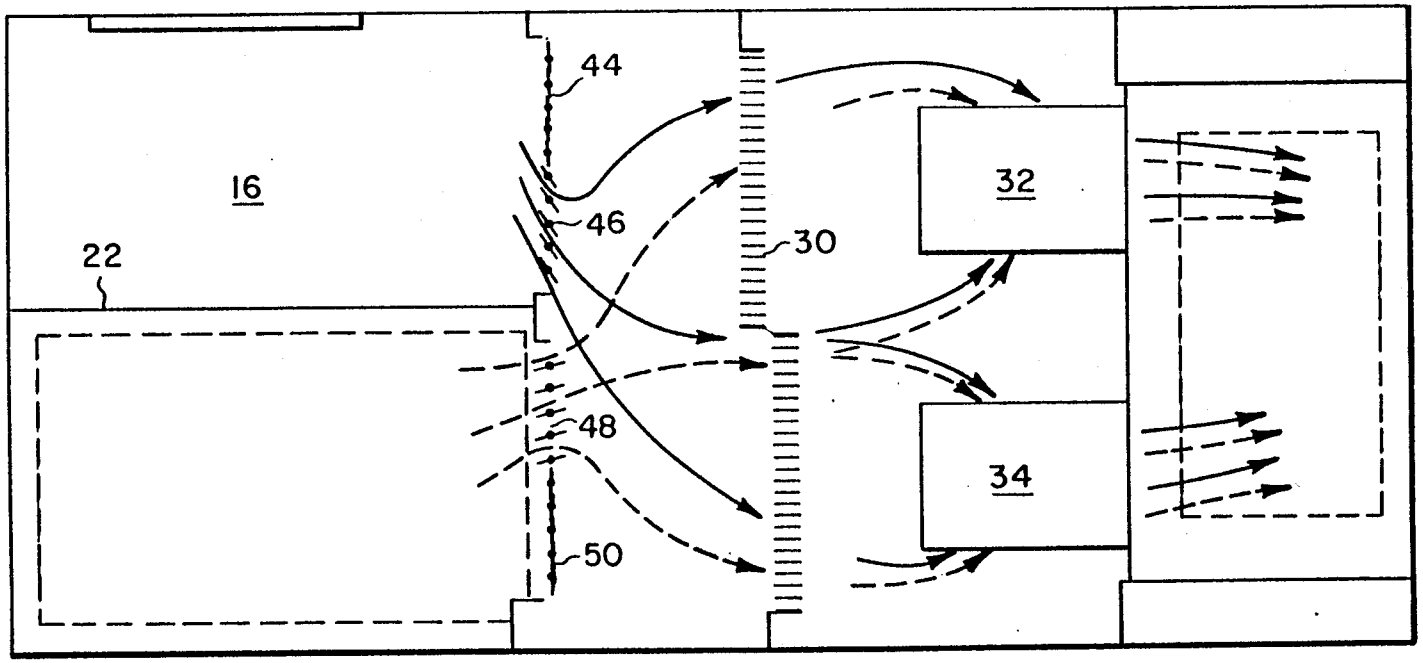
FIG. 6 is a top, schematic view depicting the air flow through the air conditioning system when the damper apparatus is configured as depicted in FIG. 2.
Figure 7:
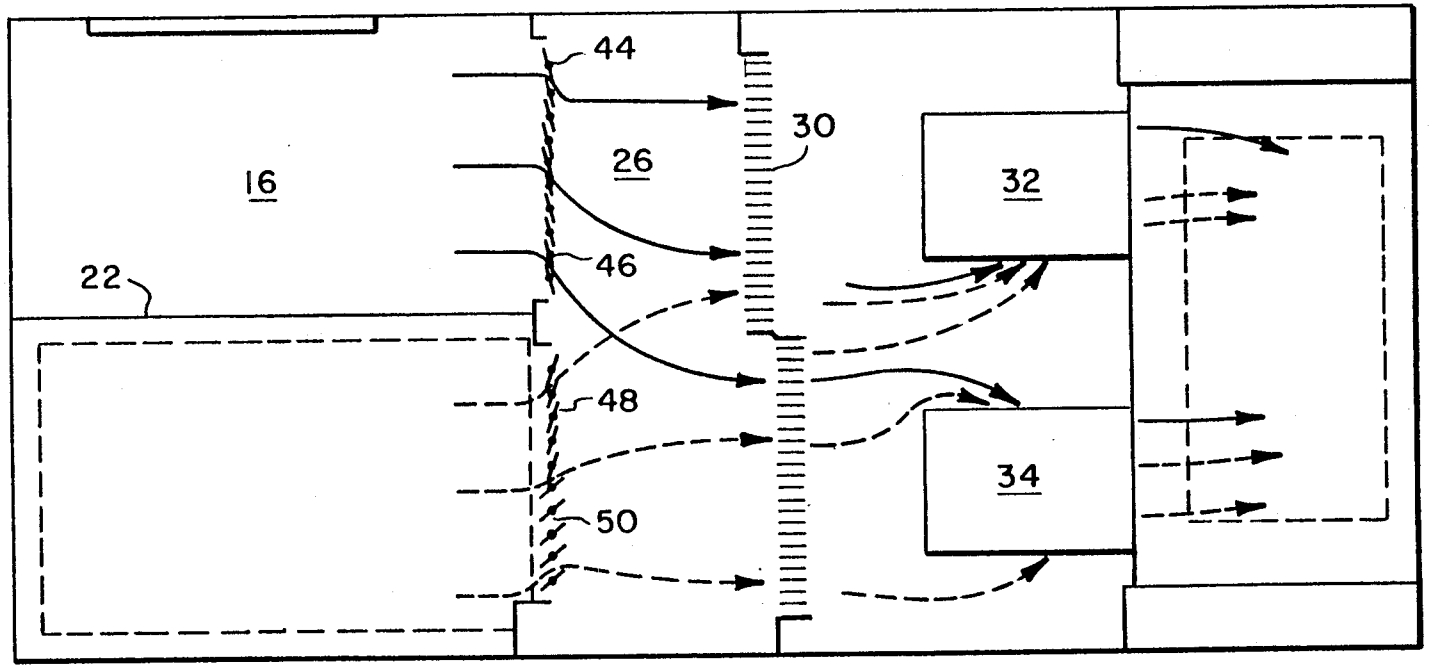
FIG. 7 is a top schematic view depicting the air flow through the air conditioning system when the damper apparatus is configured as depicted in FIG. 3.

The angle at which the vanes 52 of inner outside air damper 46 are positioned supplements the mixing effects of the increased velocity of the outside air. As shown in FIG. 2, this angle directs the flow of outside air inward to intercept the flow of return air that is flowing through inner return air damper 48. The flow paths for the outside air and the return air for this condition are depicted in FIG. 6. The combination of the inwardly directed and high velocity outside air impacting the stream of return air causes mixing of the outside air and return air in the mixing plenum 26. As can be seen in FIG. 6, a portion of the outside air is drawn into the supply fan 34, while a portion of the return air is drawn into the supply air fan 32, thus mitigating against the stratification of the supply air.

As depicted in FIG. 2, the configuration of the vanes 52 of the inner return air damper 48 is almost fully opened, while the vanes 52 of the inner outside air damper 46 are very nearly closed. This results in the flow of return air being approximately four times the flow of outside air, and corresponds to the fact that at very low outside air temperatures a substantially reduced amount of outside air is needed in order to bring the return air down to the desired supply air temperature of 55° F.

FIG. 3 depicts the configuration of damper assembly 24 on a day of relatively high outside air temperature and a relatively high air conditioning load in the building being served. Relatively high outside temperature refers to a temperature that is close to, but still somewhat less than the desired 55° F. supply air temperature. For example, the outside air temperature might be 50° F. In the configuration illustrated in FIG. 3, the total volume of air flow through the system is approximately one half of the designed air flow. This is a substantially greater flow than is the case in FIG. 2, since a greater volume of 55° F. air is needed to compensate for the increased cooling load in the building. In FIG. 3, both the vanes 52 of the inner outside air damper 46 and the inner return air damper 48 are angled such that the air flow is directed toward the center of mixing plenum 26 in order to effect mixing of the outside and return air flows. Again, by somewhat restricting the area through which the outside air and return air must flow, the velocity of both the outside air and the return air is increased, thereby further enhancing the mixing effect.

The mechanical cooling mode is depicted in FIGS. 4 and 5. In the mechanical cooling mode the compressor and heat exchange coil 30 of the air conditioning apparatus 10 are supplying the cooling. Mechanical cooling is required at times when the outside air temperature is in excess of the temperature (e.g. 55° F.) that is desired for the supply air. In mechanical cooling situations, the outer outside air damper 44 and the inner outside air damper 46 are preferably operated as a single unit. However, in practice the linkages to control the outer outside air damper 44 may be omitted and the outer outside air damper 44 left in the closed position for all modes of operation. Additionally, the inner return air damper 48 and the outer return air damper 50 are operated as a single unit. The configuration depicted in FIG. 4 would occur on a day with high outside air temperature, (e.g. 85° F.). The unitized outer outside air damper 44 and the inner outside air damper 46 are set to their minimum opening position. This admits a minimum amount of outside air to prevent the air being circulated in the building from being stuffy or stale. No cooling effect is derived from this outside air since its temperature is greater than the supply air temperature. The majority of the air that is being cooled mechanically is the return air that passes through the almost fully opened unitized inner return air damper 48 and outer return air damper 50. In this configuration, eighty percent of the air that is being returned as supply air is recooled return air. The remaining twenty percent of the supply air is made up of outside air.

FIG. 5 depicts the condition that occurs when the outside air temperature is between a temperature desired as the supply air temperature and a temperature that is desired as the temperature to be maintained in the building. For example, this could occur when the outside air temperature is between a desired 55° F. supply temperature and a 72° F. temperature is desired to be maintained within the building. For example, when the outside air is at 60° F., mechanical cooling of outside air is more efficient than recooling return air that is warmer than the outside air. In this instance, the exhaust fans 38, 40 will be energized and all the return air will be exhausted to the outside. One hundred percent of the air being supplied to the building that is serviced is outside air. Such air is passing through the open unitized outer outside air damper 44 and the inner outside air damper 46.

The present invention has been shown in tests on actual rooftop air-conditioning units to effectively abate the stratification problem that occurs in side-by-side VAV air-conditioning units that are operating at low outside air flows in the economizer mode of operation.

While the present invention has been described in the context of a preferred embodiment, it is also appreciated that there are many modifications and variations that are within the scope of the present invention so that its breadth should in no way be limited other than by the claims that follow.

I claim:

1. An air damper assembly for use in an air conditioning apparatus providing conditioned air to a space, the air conditioning apparatus having an outside air portion through which outside air is admitted to the air conditioning apparatus and a return air portion through which return air is admitted to the air conditioning apparatus, the air conditioning apparatus being selectable between a mechanical cooling mode of operation during which the cooling is provided by mechanical means and an outside air cooling mode of operation during which the cooling is provided by admitting outside air to the air conditioning apparatus, the air damper assembly comprising;

outside air damper means for controlling the admission of outside air to the air conditioning apparatus, having a first outside air damper portion that is closed during the outside air cooling mode of operation and having a second outside air damper portion that is at least partially open during the outside air cooling and mechanical cooling modes of operation;

return air damper means for controlling the admission of return air to the air conditioning apparatus, having a first return air damper portion that is closed during the outside air cooling mode of operation and is selectable between the open and closed positions during the mechanical cooling mode of operation, and having a second return air damper portion that is at least partially open during the outside air cooling mode of operation and is selectable between the open and closed positions during the mechanical cooling mode of operation;

wherein the first outside air damper portion and the second outside air damper portion operate independently during the outside air cooling mode of operation of the air conditioning apparatus and operate in unison during the mechanical cooling mode of operation of the air conditioning apparatus and the first return air damper portion and the second return air damper portion operate independently during the outside air cooling mode of operation of the air conditioning apparatus and operate in unison during the mechanical cooling mode of operation of the air conditioning apparatus.

2. An air damper assembly for use in an air conditioning apparatus providing conditioned air to a space, the air conditioning apparatus having an outside air portion through which outside air is admitted to the air conditioning apparatus and a return air portion through which return air is admitted to the air conditioning apparatus, the air conditioning apparatus being selectable between a mechanical cooling mode of operation during which the cooling is provided by mechanical means and an outside air cooling mode of operation during which the cooling is provided by admitting outside air to the air conditioning apparatus, the air damper assembly comprising;

outside air damper means for controlling the admission of outside air to the air conditioning apparatus, having a first outside air damper portion that is closed during the outside air cooling mode of operation and having a second outside air damper portion that is at least partially open during the outside air cooling and mechanical cooling modes of operation;

return air damper means for controlling the admission of return air to the air conditioning apparatus, having a first return air damper portion that is closed during the outside air cooling mode of operation and is selectable between the open and closed positions during the mechanical cooling mode of operation, and having a second return air damper portion that is at least partially open during the outside air cooling mode of operation and is selectable between the open and closed positions during the mechanical cooling mode of operation;

the air conditioning apparatus having a return air chamber and an outside air chamber situated in a side-by-side arrangement and partially defined by opposed, spaced apart, first and second air conditioning apparatus housing walls and a third partition wall interposed between said first and second walls, wherein:

the outside air damper means first outside air damper portion is disposed outwardmost generally adjacent to said first air conditioning apparatus housing wall and the second outside air damper portion disposed inwardmost generally adjacent to the partition wall; and the return air damper means the first return air damper portion is disposed outwardmost generally adjacent to said second air conditioning apparatus housing wall and the second return air damper portion is disposed inwardmost generally adjacent to the partition wall.

3. An air damper assembly for use in an air conditioning apparatus providing conditioned air to a space, the air conditioning apparatus having an outside air portion through which outside air is admitted to the air conditioning apparatus and a return air portion through which return air is admitted to the air conditioning apparatus, the air conditioning apparatus being selectable between a mechanical cooling mode of operation during which the cooling is provided by mechanical means and an outside air cooling mode of operation during which the cooling is provided by admitting outside air to the air conditioning apparatus, the air damper assembly comprising;

outside air damper means for controlling the admission of outside air to the air conditioning apparatus, having a first outside air damper portion that is closed during the outside air cooling mode of operation and having a second outside air damper portion that is at least partially open during the outside air cooling and mechanical cooling modes of operation;

return air damper means for controlling the admission of return air to the air conditioning apparatus, having a first return air damper portion that is closed during the outside air cooling mode of operation and is selectable between the open and closed positions during the mechanical cooling mode of operation, and having a second return air damper portion that is at least partially open during the outside air cooling mode of operation and is selectable between the open and closed positions during the mechanical cooling mode of operation;

wherein the second outside air damper portion is comprised of a plurality of variably positionable second outside air damper portion vane means for defining the area of the opening through which the outside air is admitted and controlling the velocity of the flow of the admitted outside air, and means for selectively positioning the second outside air damper portion vane means in unison through a range of motion defining fully closed and fully open positions, and the second return air damper portion is comprised of a plurality of variably positionable second return air damper portion vane means for defining the area of the opening through which the return air is admitted and controlling the velocity of the flow of the admitted return air, and means for selectively positioning the second return air damper portion vane means through a range of motion defining a fully closed position and a fully open position; and wherein the vane means comprising the second outside air damper portion are angled to direct the flow of admitted outside air toward the flow of admitted return air at all positions between the fully open and fully closed positions and the vane means comprising the second return air damper portion are angled to direct the flow of admitted return air toward the flow of admitted outside air at all positions between the fully open and fully closed positions to promote a uniform temperature distribution throughout the conditioned air.

4. An air damper assembly as claimed in claim 3, wherein the first outside air damper portion is closed during the mechanical cooling mode of operation.

5. An air damper assembly for use in an air conditioning system that provides conditioned air to a space having a return air admitting portion and an outside air admitting portion, air conditioning system having a return air admitting portion and an outside air admitting portion arranged in a side-by-side fluidly separated orientation, comprising;

a return air damper sub assembly means for controlling the flow of return air, defining a return air aperture through which return air flows, the return air damper sub assembly means having a first return air aperture control means for controlling the opening and closing of a first portion of the return air aperture and a second return air aperture control means for controlling the opening and closing of a second portion of the return air aperture; and, an outside air damper sub assembly means for controlling the flow of outside air, defining an outside air aperture through which outside air flows, the outside air damper sub-assembly means having a first outside air aperture control means for controlling the opening and closing a first portion of the outside air aperture and a second outside air aperture control means for controlling the opening and closing of a second portion of the outside air aperture;

wherein:

the first outside air aperture control means is disposed outwardly in said outside air admitting portion and the second outside air aperture control means is disposed inwardly in said outside air admitting portion generally adjacent to the return air admitting portion, the first return air aperture control means is disposed outwardly in said return air admitting portion and the second return air aperture control means is disposed inwardly in said return air admitting portion generally adjacent to the outside air admitting portion, and the second outside air aperture control means selectively directs the flow of outside air toward the return air admitting portion and the second return air aperture control means selectively directs the flow of return air toward the outside air admitting portion to promote a uniform temperature distribution throughout the conditioned air.

6. The air damper assembly as claimed in claim 5, including; controller means for selectively independently controlling the first return air aperture control means, the second return air aperture control means, the first outside air aperture control means, and the second outside air aperture control means such that the aperture area presented by each of said aperture control means is independently selectable such that the aperture area controlled by each of said aperture control means may be coordinated with the aperture area controlled by one or more of the other said aperture control means.

7. The air damper assembly as claimed in claim 5, wherein the second outside air aperture control means comprises a plurality of vane means for selectively directing the flow of outside air and wherein the second return air aperture control means comprises a plurality of vane means for selectively directing the flow of return air, such that return air and outside air is mixed together.

8. The air damper assembly as claimed in claim 5, wherein the second portion of the return air aperture and the second portion of the outside air aperture are controlled together.

9. In an air conditioning system that supplies conditioned air to a space presenting an air conditioning demand, the air conditioning system having a return air admitting portion and an outside air admitting portion and an air damper assembly, the air damper assembly having a return air damper subassembly that controls the flow of return air, the return air damper subassembly having a first portion and a second portion, and an outside air damper subassembly that controls the flow of outside air, the outside air damper subassembly having a first portion and a second portion, the air conditioning apparatus having a return air chamber and an outside air chamber situated in a side-by-side arrangement and partially defined by opposed, spaced apart, first and second air conditioning apparatus housing walls and a third partition wall interposed between said first and second walls, therein:

the first outside air damper subassembly portion is disposed outwardmost generally adjacent to said first air conditioning apparatus housing wall and the second outside air damper subassembly portion is disposed inwardmost generally adjacent to the partition wall; and the first return air damper subassembly portion is disposed outwardmost generally adjacent to said second air conditioning apparatus housing wall and the second return air damper subassembly portion is disposed inwardmost generally adjacent to the partition wall, the method of promoting a uniform temperature distribution throughout the conditioned air comprising;

closing the first portion of the return air damper subassembly and closing the first portion of the outside air damper subassembly and at least partially opening the second portion of the return air damper subassembly and the second portion of the outside air damper subassembly at times of relatively low outside air flow; and at least partially opening the second portion of the outside air damper subassembly and varying the first and second portions of the return air damper subassembly between the open and closed positions as a function of outside air temperature and cooling demand at times of relatively high outside air flow.

10. The method of claim 9 including the further step of at least partially opening the first portion of the outside air damper assembly at times of relatively high outside airflow.

11. In an air conditioning system that supplies conditioned at a set conditioned air temperature air to a space presenting an air conditioning demand, wherein the conditioned air is at least partially made up of outside air, the air conditioning system having a return air admitting portion and an outside air admitting portion and an air damper assembly, the air damper assembly having a return air damper subassembly that controls the flow of return air, the return air damper subassembly having a first portion and a second portion, and an outside air damper subassembly that controls the flow of outside air, the outside air damper subassembly having a first portion and a second portion, the method of promoting a uniform temperature distribution throughout the conditioned air, comprising the steps of:

comparing the outside air temperature to the conditioned air temperature;

closing the first portion of the return air damper subassembly and the first portion of the outside air damper subassembly at substantially all times when the conditioned air temperature exceeds the outside air temperature;

varying the position of the second portion of the return air damper subassembly between the fully closed and the fully open positions as a function of the difference between the outside air temperature and the conditioned air temperature and the air conditioning demand at substantially all times when the conditioned air temperature exceeds the outside air temperature; and, varying the position of the second portion of the outside air damper subassembly between the fully closed position and a partially open position as a function of the difference between the outside air temperature and the conditioned air temperature and the air conditioning demand at substantially all times when the conditioned air temperature exceeds the outside air temperature.

12. In an air conditioning system that supplies conditioned at a set conditioned air temperature air to a space presenting an air conditioning demand, wherein the conditioned air is at least partially made up of outside air, the air conditioning system having a return air admitting portion and an outside air admitting portion and an air damper assembly, the air damper assembly having a return air damper subassembly that controls the flow of return air, the return air damper subassembly having a first portion and a second portion, and an outside air damper subassembly that controls the flow of outside air, the outside air damper subassembly having a first portion and a second portion, the air conditioning apparatus being selectable between a mechanical cooling mode of operation during which the cooling is provided by mechanical means and an outside air cooling mode of operation during which the cooling is provided by admitting outside air to the air conditioning apparatus, the method of promoting a uniform temperature distribution throughout the conditioned air comprising the steps of:

comparing the outside air temperature to the conditioned air temperature;

varying the positions of the first and second portions of the return air damper subassembly between the fully closed position and at least a partially open position at substantially all times when the conditioned air temperature is less than the outside air temperature as a function of the difference between the outside air temperature and the conditioned air temperature and the air conditioning demand;

varying the positions of the first and second portions of the outside air damper subassembly between the fully open position and at least a partially open position at substantially all times when the conditioned air temperature is less than the outside air temperature as a function of the difference between the outside air temperature and the conditioned air temperature and the air conditioning demand;

operating the first outside air damper portion and the second outside air damper portion independently during the outside air cooling mode of operation of the air conditioning apparatus;

operating the first outside air damper portion and the second outside air damper portion in unison during the mechanical cooling mode of operation of the air conditioning apparatus;

operating the first outside air damper portion and the second return air damper portion independently during the outside air cooling mode of operation of the air conditioning apparatus; and operating the first outside air damper portion and the second return air damper portion in unison during the mechanical cooling mode of operation of the air conditioning apparatus.

* * * * *